United States Patent [19]

Claesson et al.

[11] Patent Number: 4,849,592

[45] Date of Patent: Jul. 18, 1989

[54] FEEDING ARRANGEMENT FOR A MICROWAVE OVEN

[75] Inventors: Jan S. Claesson, Linköping; Per O. G. Risman, Herryda, both of Sweden

[73] Assignee: U.S. Philips Corp., New York, N.Y.

[21] Appl. No.: 151,143

[22] Filed: Feb. 1, 1988

[30] Foreign Application Priority Data

Feb. 3, 1987 [SE] Sweden ..... 8700399

[51] Int. Cl.[4] ..... H05B 6/72

[52] U.S. Cl. ..... 219/10.55 F

[58] Field of Search ..... 219/10.55 F, 10.55 R, 219/, 10.55 E

[56] References Cited

U.S. PATENT DOCUMENTS

| | | | |
|---|---|---|---|
| 3,746,823 | 7/1973 | Whiteley | 219/10.55 F |
| 4,342,896 | 8/1982 | Teich | 219/10.55 F |
| 4,343,976 | 8/1982 | Nasretdin et al. | 219/10.55 F |
| 4,430,539 | 2/1984 | Suzuki | 219/10.55 F |
| 4,496,814 | 1/1985 | Fitzmayer | 219/10.55 F |
| 4,580,023 | 4/1986 | Simpson | 219/10.55 F |
| 4,695,693 | 9/1987 | Staats et al. | 219/10.55 F |

*Primary Examiner*—Philip H. Leung

*Attorney, Agent, or Firm*—Emmanuel J. Lobato

[57] ABSTRACT

An arrangement for feeding microwave energy from a microwave source (14) to the oven cavity (10) of a microwave oven comprises an elongated groove-shaped recess (16) in one of the conductive cavity walls (17), into which recess (16) microwave energy is fed at a centrally located feeding point (15). At its open side the recess (16) is covered by a rotatable conductive plate (22) arranged very close to the cavity wall (17) so that the recess (16) together with the plate (22) will form a waveguide-like structure. The plate (22) is shaped so that during its rotation time-varying feeding passages between the recess (16) and the oven cavity (10) are formed at both opposite ends of the recess, the passages allowing the transfer of microwave energy from the recess (16) to the cavity (10). These measures result in a very simple and space-saving arrangement of the "dual feed" type.

15 Claims, 1 Drawing Sheet

FEEDING ARRANGEMENT FOR A MICROWAVE OVEN

BACKGROUND OF THE INVENTION

The invention relates to an arrangement in a microwave oven for feeding microwave energy from a microwave source mounted external of an oven cavity bounded by a plurality of conductive walls into the interior of the oven cavity. More particularly, it relates to a feeding arrangement for an oven cavity that is excited in a conventional manner according to the well-known "multiresonance" principle.

Several known feeding arrangements for multiresonant oven cavities are based upon a movable metallic antenna that projects into the oven cavity and that is coupled, usually through a waveguide of $TE_{10}$-type, to a microwave source in the form of a magnetron. On the one hand this antenna can be regarded as an antenna in a conventional sense, i.e. as an element that can be described as having a radiation diagram, and on the other hand as a structure cooperating with the resonant modes in the cavity in a variable manner and thereby providing a varying coupling between the microwave input power and the resonant modes in dependence on the antenna position. In both cases, the result is that a number of different resonant modes are excited in succession, and that—in particular for large loads in the oven when the figure of merit (Q-factor) for resonant modes can be so low that it is not appropriate to consider the field as being resonant—a direct radiation into the load takes place.

In order to achieve a good microwave energy distribution in the oven cavity and more uniform heating of the load it has also been proposed that microwave energy be fed into the cavity at two spatially separated feeding points, an arrangement known as "dual feed". Reference may be made to the following prior art documents:

U.S. Pat. No. 3,939,320 describes an energy feeding arrangement that includes a resonant coupling structure disposed near a centrally located feeding point in the top of the oven cavity. This resonant structure is in the shape of a short hollow cylinder of conductive material which rotates eccentrically to spread an energy beam in many directions and which is contained in a "feed box" to produce energy reflections and facilitate protection by means of a cover permeable to microwaves.

U.S. Pat. No. 4,133,997 describes an arrangement for feeding energy to the oven cavity by means of rotating stirrers contained in "feed boxes" that are mounted to each of two opposite side walls. This "dual feed" arrangement is used to achieve a more uniform heating of the load in the oven cavity. Microwave energy is supplied to the feed boxes through a waveguide from a single magnetron resulting in an arrangement that is complicated and expensive.

U.S. Pat. No. 3,993,886 describes another type of dual feed arrangement including a flared waveguide into which microwave energy from a magnetron is fed at its smaller end. Microwave energy from several resonant modes of the TE-type is fed from the flared waveguide into the oven cavity through two coupling apertures at its wider end, in which apertures small rotating stirrers are placed for further improving the energy distribution in the oven cavity. U.S. Pat. No. 4,249,058 describes a similar dual feed arrangement that utilizes, however, rotating stirrers of a considerably larger diameter. An attempt at realizing a dual feed arrangement of more compact dimensions is found in U.S. Pat. No. 3,439,143. This arrangement comprises a rectangular waveguide to feed microwave energy from a magnetron to the oven cavity through two coupling apertures on both sides of a reflector of conductive material located within the waveguide and mounted off-axis to a rotating support of material that is transparent to microwaves. However, this compact arrangement does not achieve the advantage of that according to U.S. Pat. No. 3,993,886 producing several simultaneously existing resonant modes in the waveguide, nor the advantage of the arrangement according to U.S. Pat. No. 4,249,058 having rotating stirrers covering a substantial area of the top wall of the oven cavity.

U.S. Pat. No. 3,814,890 describes an arrangement for feeding microwave energy from a magnetron directly into the oven cavity without using an intermediate waveguide. This arrangement comprises a large feed box in the shape of a truncated cone having an aperture at its truncated end through which the radiating portion of the magnetron extends, but it does not comprise rotating antennas or stirrers for improving the energy distribution in the oven cavity.

SUMMARY OF THE INVENTION

It is an object of the present invention to provide a mechanically simple, inexpensive and spacesaving arrangement for feeding energy from a microwave source into the microwave oven cavity without using conventional intermediate waveguides, but still having the advantages of a duel feed arrangement.

According to the invention such a feeding arrangement is characterized in that the arrangement comprises:

an elongated groove-shaped recess in one of said conductive cavity walls having a microwave energy feeding point directly connected to the microwave source; and an essentially plane, periodically movable conductive plate arranged within the oven cavity in front of the recess and very close to said one conductive cavity wall, said plate being shaped and dimensioned so that, at least during a part of the periodic movement, periodically varying passages between the recess and the oven cavity at both ends of the recess are formed, said passages allowing microwave energy to radiate into the interior of the oven cavity.

The combination of the elongated groove-shaped recess with the conductive plate arranged very close to the cavity wall will form a $TE_{10}$-type waveguide-like structure that is supplied with microwave energy at a centrally located feeding point and, owing to the fact that the plate is shaped so that periodically varying passages are formed at both ends of the elongated recess, a dual feed arrangement has been obtained in a very simple manner without using any waveguide system proper.

Suitably, the recess has a substantially rectangular cross section and is terminated at both ends by oblique portions that continue in the cavity wall. By these oblique portions at the ends of the recess, where the energy radiates into the cavity, the energy transfer from the recess to the cavity will be facilitated.

The essentially plane plate of conductive material is preferably rotatably mounted about an axis of rotation that is centrally located in the recess and substantially coincides with the microwave energy feeding point in the recess, and this plate has two diametrically opposite sections which, when these sections pass each end of the recess, provide for mutually different passages between the recess and the cavity that vary periodically with the rotation of the plate.

Besides serving as rotating antenna, the rotating plate will also cause a resonance balance variation and a wobbling of certain cavity resonant modes because the radiating feeding zones will move somewhat with the antenna rotation.

Suitably, the conductive plate or antenna can be shaped so that one of the sections is bounded by an outer edge which is closer to the axis of rotation than the ends of the elongated recess, resulting in that a passage is formed between the said outer edge and the end of the elongated recess when the relevant section passes the recesses.

Preferably, the plate has also at least one feeding aperture which is close to the axis of rotation and through which microwave energy will continuously be fed into the cavity.

This way of realizing the plate with two diametrically opposite feeding passages, one of which is simply bounded partially by an outer edge of the plate, and with a centrally located feeding aperture will result in a maximally simple antenna plate construction, which nevertheless has proved to give a very good energy distribution in the cavity.

If the magnetron is heavily or strongly coupled to the wave propagating in the elongated recess, for instance if the antenna of the magnetron projects into the recess, then reactive pins, known as "stubs", can be arranged in the bottom of the recess on each side of the feeding point.

In a preferred embodiment, the reactive pins are formed by the fastening screws for the magnetron or extensions of these screws.

BRIEF DESCRIPTION OF THE DRAWING

The invention will now be described in more detail, by way of non-limitative example, with reference to the accompanying drawing figures, in which.

DESCRIPTION OF THE PREFERRED EMBODIMENT

Figure 1:
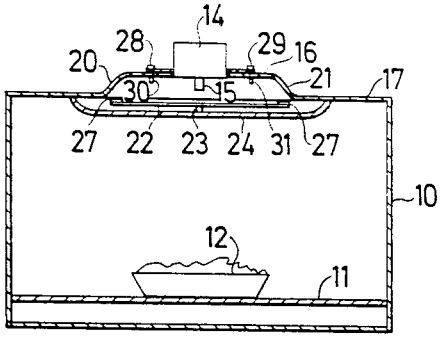
FIG. 1 shows a vertical sectional view of a microwave oven comprising a feeding arrangement according to the invention.
Figure 2:
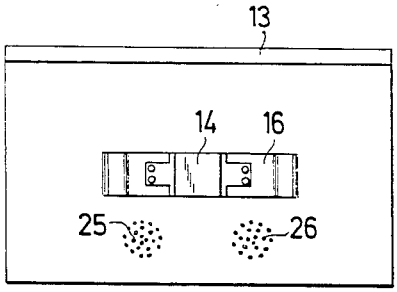
FIG. 2 shows a plan view of the same oven seen from above.
Figure 3:
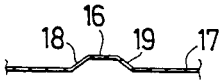
FIG. 3 shows a sectional view of a part of the cavity top walls in which a groove-shaped recess is made as a component of the feeding arrangement according to the invention.

In FIGS. 1 and 2, reference numeral 10 designates an oven cavity bounded by conductive walls, reference numeral 11 designates a bottom shelf on which food 12 to be heated is placed, reference numeral 13 designates a door which gives access to the oven cavity 10 and reference numeral 14 designates a magnetron having an antenna or radiator 15. According to the invention, the magnetron 14 is mounted on the outside of an elongated groove-shaped recess 16 in the cavity top wall 17 so that the antenna 15 projects into the central part of the recess. As is apparent from FIG. 2, the recess 16 has a substantially rectangular cross section, but alternatively the recess 16 can have a cross section with essentially oblique side walls 18 and 19, as shown in FIG. 3. At both ends, the elongated recess 16 is terminated by two oblique end portions 20 and 21 that continue in the top wall 17, as shown in FIG. 1.

In front of the recess 16 there is a plane conductive plane 22 that is rotatably journalled about a rotation shaft 23 protruding from a protective envelope 24 permeable or transparent to microwaves. The plate 22 is driven by cooling-air for magnetron 14 that is supplied through entrance apertures 25 and exhausted through exit apertures 26 in the cavity top wall 17 (FIG. 2). For that purpose the plate 22 provided with microwave-transparent wings 27 on which the air-flow impinges so as to cause the plate 22 to rotate. In the example shown, the axis of rotation coincides with the center of the recess 16 and thus with the feeding point for the microwave energy that is formed by the magnetron antenna 15.

The conductive plate 22 is arranged very close to the cavity top wall 17 and covers the open side of the groove-shaped recess 16. The combination of the recess 16 with the plate 22 will therefore form a waveguide-like structure that is fed centrally via the antenna 15 and in which the microwave energy propagates towards both ends of the recess 16. The plate 22 is shaped so that, during each revolution, time-varying coupling passages are formed between the recess 16 and the oven cavity, through which passages microwave energy is fed into the cavity.

In the example shown, the fastening screws 28, 29 for the magnetron are provided with extensions 30, 31 and these screws are positioned and dimensioned so that they serve as reactive impedance matching elements, known as "stubs", for the magnetron 14.

Figure 4:
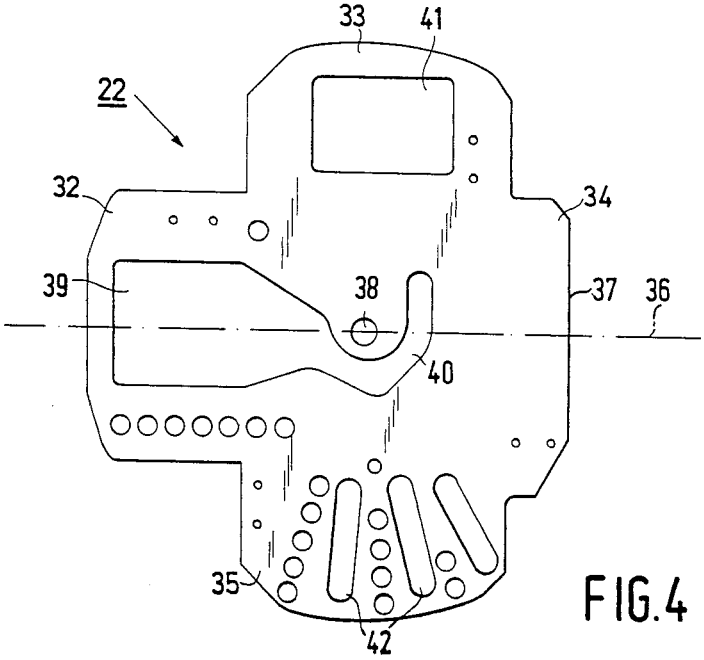
FIG. 4 shows a plan view in enlarged scale of the rotatable antenna plate.

An example of a suitable shape of the antenna plate 22 is shown in FIG. 4. According to FIG. 4, the antenna plate, which is suitably manufactured by punching of a conductive sheet, consists of four wings 32, 33, 34, 35 which all produce coupling between the grooveshaped recess and the cavity when passing the recess but which are all mutually different. The two wings that are substantially responsible for the energy transfer to and energy distribution in the cavity are the wings that, at a given moment, are situated opposite to the ends of the recess 16.

With the antenna position shown in the figure, where the longitudinal axis of symmetry of the recess 16 is indicated by a broken line 36, it is the wings 32 and 34 that are responsible for the energy transfer. One of these wings, wing 34 in the figure, consists simply of a short piece of sheet, the outer edge 37 of which is so close to the center 38 of rotation that, when this wing 34 coincides with the elongated recess, a feeding passage will be formed between the edge 37 and the adjacent end of the elongated recess. The opposite wing 32 has a feeding passage 39 that extends approximately to the relevant end of the elongated recess when the wing 32 coincides with the recess. At the central part of the plate, this feeding passage 39 continues in an arcuate slot 40 that curves around the center 38 of rotation and that also serves as a feeding aperture.

The two other wings 33 and 35 are provided with mutually different feeding passages 41, 42 which are located relatively close to the periphery of the plate 22 and will lie relatively close to the ends of the elongated recess when these wings 33 and 35 coincide with the recess.

In all positions of the antenna plate 22, the feeding arrangement operates so as to propagate microwave energy in the elongated recess 16 from the centrally located feeding point, which coincides with the axis of rotation (shaft 23), towards the ends of the recess 16, where the microwave energy will be transferred to the oven cavity to the extent that any of the openings in the plate 22 coincides with the elongated recess. Owing to the rotation of the plate 22, the size and position of the feeding passages will vary continuously with time, resulting in a complex excitation of the cavity and thereby in a good energy distribution. The central feeding slot 40 continuously radiates energy into the cavity, but also this feeding is time-variable owing to the changing position of the slot during the rotation.

What is claimed is:

1. In a microwave oven having a microwave source mounted external to an oven cavity bounded by a plurality of conductive walls for feeding microwave energy into the interior of the oven cavity, the improvement comprising:

an elongated groove-shaped recess in one of said conductive cavity walls;

a microwave radiator directly connected to the microwave source and positioned for injecting microwave radiation into the recess;

an essentially plane, periodically movable asymmetrical conductive plate, having different transverse dimenions and being asymmetrical relative to its center, arranged within the oven cavity in front of the recess and proximate said one conductive cavity wall, said plate being shaped and dimensioned so that, during a periodic movement of said plate, periodically varying passages between the recess and the oven cavity at both ends of the recess are formed, said passages allowing microwave energy to radiate into the interior of the oven cavity and mounting means for mounting said asymmetrical conductive plate for periodic movement relative to said recess.

2. An arrangement as claimed in claim 1, characterized in that the recess is terminated at both ends by oblique portions that continue in said one cavity wall.

3. An arrangement as claimed in claims 1 or 2, characterized in that the microwave energy feeding point is centrally located in the recess.

4. An arrangement as claimed in claim 1 or 2, characterized in that the recess has a substantially rectangular cross section.

5. An arrangement as claimed in claim 1 or 2, characterized in that said essentially plane conductive plate is rotatably mounted about an axis of rotation located centrally in the recess and substantially coinciding with the microwave radiator, and in that said plate comprises at least two diametrically opposite sections having mutually different openings which are positioned and dimensioned that so as to allow transfer of microwave energy from the recess to the oven cavity at both ends of the recess when said two sections coincide with the recess during the rotary movement of said plate; and said mounting means comprising means for mounting said asymmetrical conductive plate for rotation about said axis of rotation.

6. An arrangement as claimed in claim 5, characterized in that one of said sections is bounded by an outer edge which is closer to the centrally located axis of rotation than the ends of the elongated recess, so that a feeding passage is formed between said outer edge and the relevant end of the recess when said one section passes the recess.

7. An arrangement as claimed in claim 6, characterized in that said conductive plate also has at least one feeding aperture which is close to the axis of rotation and through which microwave energy is continuously fed into the oven cavity.

8. An arrangement as claimed in claim 5, characterized in that said conductive plate also has at least one feeding aperture which is close to the axis of rotation and through which microwave energy is continuously fed into the oven cavity.

9. An arrangement as claimed in claim 1 or 2 in which the microwave source formed by a magnetron is strongly coupled to the wave propagating in the recess, characterized in that impedance matching stubs in the shape of reactive pins are arranged in the bottom of the recess on opposite sides of the microwave energy feeding points.

10. An arrangement as claimed in claim 9, characterized in that said reactive pins are formed by the fastening screws for the magnetron or extensions of said screws.

11. In a microwave oven having an oven cavity comprised of conductive walls, and a microwave source external to the oven cavity, the improvement comprising:

one of said conductive cavity walls having an elongated recess having a certain length and defining a portion of a waveguide;

a thin conductive asymmetrical plate having different transverse dimensions approximately equal to or less than the length of said recess as measured through the plate center, and having peripheral apertures of non-uniform sizes positioned asymmetrically around the periphery of said asymmetrical plate;

mounting means for mounting said asymmetrical plate for rotation about its center at a position proximate said one of said cavity walls having said elongated recess and covering said recess for jointly defining the waveguide with said recess;

said microwave source disposed externally of said cavity having a radiator positioned for injecting microwave radiation into said recess for propagation within the waveguide defined by said recess and said asymmetrical plate toward the respective ends thereof; and microwave radiation flowing out of the waveguide through apertures of said asymmetrical plate opposite said recess and into said cavity in dependence upon the angular position of said asymmetrical plate relative to said recess, whereby rotation of said asymmetrical plate is effective to progressively change the overlap of plate apertures and recess for progressively changing the pattern of radiation from the end regions of said waveguides.

12. In a microwave oven according to claim 11, wherein said radiator is positioned at the middle of said recess, and said asymmetrical plate has an arcuate aperture partially surrounding the center of said asymmetrical plate and approximately opposite said radiator for permitting microwaves from said radiator to pass through said arcuate aperture into said cavity.

13. In a microwave oven according to claim 11 or 12, wherein said asymmetrical plate has a transverse dimension along one direction through said plate center that is less than the length of said recess for defining an apertures for the passage of microwaves between said plate and said recess when said asymmetrical plate is positioned with said transverse dimension along said one direction aligned with said recess.

14. In a microwave oven according to claim 13, wherein said mounting means is comprised of a protective envelope transparent to microwaves positioned within said cavity and covering said asymmetrical plate, a shaft extending from said envelope toward the center of said asymmetrical plate for mounting said asymmetrical plate for rotation, and said asymmetrical plate having a central opening for receiving said shaft for rotation thereon.

15. In a microwave oven according to claim 11 or 12, wherein said mounting means is comprised of a protective envelope transparent to microwaves positioned within said cavity and covering said asymmetrical plate, a shaft extending from said envelope toward the center of said asymmetrical plate for mounting said asymmetrical plate for rotation, and said asymmetrical plate having a central opening for receiving said shaft for rotation thereon.

* * * * *